US009318252B2

(12) United States Patent
Liu et al.

(10) Patent No.: US 9,318,252 B2
(45) Date of Patent: Apr. 19, 2016

(54) MAGNETIC CORE AND MAGNETIC COMPONENT USING THE SAME

(71) Applicant: DELTA ELECTRONICS, INC., Taoyuan Hsien (TW)

(72) Inventors: Teng Liu, Taoyuan Hsien (TW); Ke Dai, Taoyuan Hsien (TW); Ming-Hui Dai, Taoyuan Hsien (TW)

(73) Assignee: DELTA ELECTRONICS, INC. (TW)

( * ) Notice: Subject to any disclaimer, the term of this patent is extended or adjusted under 35 U.S.C. 154(b) by 111 days.

(21) Appl. No.: 14/065,458

(22) Filed: Oct. 29, 2013

(65) Prior Publication Data

US 2014/0320255 A1 Oct. 30, 2014

(30) Foreign Application Priority Data

Apr. 25, 2013 (CN) ..... 2013 1 0147928

(51) Int. Cl.

| | |
|---|---|
| ***H01F 17/04*** | (2006.01) |
| ***H01F 27/24*** | (2006.01) |
| ***H01F 3/10*** | (2006.01) |
| ***H01F 27/28*** | (2006.01) |

(52) U.S. Cl.

CPC ..... *H01F 27/24* (2013.01); *H01F 3/10* (2013.01); *H01F 27/28* (2013.01); *H01F 2003/103* (2013.01); *H01F 2003/106* (2013.01)

(58) Field of Classification Search

CPC ..... H01F 2003/106
USPC ..... 336/233, 221
See application file for complete search history.

(56) References Cited

U.S. PATENT DOCUMENTS

| | | | | |
|---|---|---|---|---|
| 3,668,589 | A | 6/1972 | Wilkinson | |
| 4,943,793 | A | 7/1990 | Ngo et al. | |
| 5,062,197 | A | 11/1991 | Ngo et al. | |
| 5,731,666 | A * | 3/1998 | Folker et al. | 315/276 |
| 6,980,077 | B1 * | 12/2005 | Chandrasekaran et al. | 336/212 |
| 8,405,478 | B1 * | 3/2013 | Dai | 335/297 |
| 2003/0030529 | A1 | 2/2003 | Ming et al. | |
| 2008/0074230 | A1 | 3/2008 | Chen et al. | |
| 2010/0102917 | A1 * | 4/2010 | Liu et al. | 336/221 |

FOREIGN PATENT DOCUMENTS

| | | |
|---|---|---|
| CN | 2798268 | 7/2006 |
| CN | 102368425 | 3/2012 |
| EP | 1498915 | 1/2005 |
| EP | 2001028 | 12/2008 |
| GB | 2338837 | 12/1999 |
| JP | H03-240211 | 10/1991 |
| WO | 01/75915 | 10/2011 |

* cited by examiner

*Primary Examiner* — Mangtin Lian
*Assistant Examiner* — Ronald Hinson
(74) *Attorney, Agent, or Firm* — Hauptman Ham, LLP

(57) ABSTRACT

A magnetic core and a magnetic component using the same are disclosed. The magnetic core has a first magnetic material and a non-uniform filling section in connection; also, the magnetic core has a magnetic flux direction, for which the non-uniform filling section perpendicular to the magnetic flux direction contains at least two kinds of magnetic material. Comparing to a conventional uniform-filling magnetic core, the non-uniform filling section within the magnetic component of the magnetic core can provide higher initial inductance and better DC-bias characteristics; this improved magnetic component can provide higher inductance in specific mandatory loads, or less efficiency loss in a condition of the same inductance provided.

14 Claims, 15 Drawing Sheets

MAGNETIC CORE AND MAGNETIC COMPONENT USING THE SAME

RELATED APPLICATIONS

This application claims priority to China Application Serial Number 201310147928.8, filed Apr. 25, 2013, which is herein incorporated by reference.

BACKGROUND

1. Field of Invention

The present invention relates to a magnetic component. More particularly, the present invention relates to a magnetic core.

2. Description of Related Art

A regular magnetic component, such as an inductor or a transformer, comprises a magnetic core generating a closed magnetic loop, and a set of winding coil winding on the magnetic core. Examples of traditional magnetic components 10 are shown respectively in FIG. 1A to FIG. 1C. The magnetic component 10 comprises a magnetic core 20 and a set of winding coil which winds on the magnetic core 20. The magnetic core 20 comprises a plurality of magnetic columns 22 and a plurality of magnetic covers 24 for connecting the magnetic columns for inducing the closed magnetic loop. The magnetic covers 24 are parallel to each other and placed in opposed sides of the magnetic column 22. The magnetic core 20 has a magnetic flux direction M, which passes the left, right columns 22 and top, bottom magnetic covers 24 to induce the magnetic loop. The magnetic component 10 also comprises a set of winding coil 30, winding on the column 22.

A conventional magnetic core 20 is often made by a uniform-filling method. The so-called uniform-filling method means that the magnetic core 20 is composed of a same magnetic material at the cross section perpendicular to the magnetic flux direction M. For example, the magnetic core 20 can be composed of a single kind of magnetic material, as shown in FIG. 1A, or can be composed by two kinds of magnetic material connected in parallel at always, as shown in FIG. 1B, or by two kinds of magnetic material connected in series, as shown in FIG. 1C.

Since the magnetic permeability of a magnetic material decreases with an increase of magnetic field intensity, generally speaking, the inductance of reactor or inductor would decrease along with a DC-bias current applied increasingly. In case of the DC component of load current is in a significant amount, Better DC-bias characteristics could keep a higher inductance and a less variation between the initial inductance (i.e., the inductance when a current of zero passes an inductor) and the inductance under the DC-bias current. As such, it becomes a challenge to retain the better DC-bias characteristics in the case that a DC component of a load current is in a significant amount.

SUMMARY

The present invention provides a magnetic core to induce higher initial inductance for magnetic components and better DC-bias characteristics.

One aspect of the present invention provides a magnetic core having a magnetic flux direction. The magnetic core comprises a first magnetic material and at least one non-uniform filling section connected to the first magnetic material, in which the non-uniform filling section comprises a plurality of magnetic materials with at least two different values of initial magnetic permeability at a cross section perpendicular to the magnetic flux direction. Another aspect of the present invention provides a magnetic component that utilizes the mentioned magnetic core, comprising the magnetic core and a set of winding coil winding on a magnetic column of the magnetic core.

Yet another aspect of the present invention provides a magnetic core having a plurality of magnetic columns, a plurality of magnetic covers, and a magnetic flux direction. The magnetic core comprises a first magnetic material and a non-uniform filling section disposed at a corner of connection between the magnetic columns and the magnetic covers. The non-uniform filling section comprises a second magnetic material and a third magnetic material having values of initial magnetic permeability different to each other, and the second magnetic material and the third magnetic material are disposed at the outer and inner side of the magnetic core, respectively. Another aspect of the present invention provides a magnetic component that utilizes the mentioned magnetic core, comprising the magnetic core and a set of winding coil winding on a magnetic column of the magnetic core.

Comparing to the conventional uniform-filling magnetic core, the magnetic core of the present magnetic component utilizes the non-uniform filling design, such that the present magnetic component can provide higher initial inductance and better DC-bias characteristics; this improved magnetic component can provide higher inductance in specific loads, or less loss in a condition of the same inductance applied.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1A:
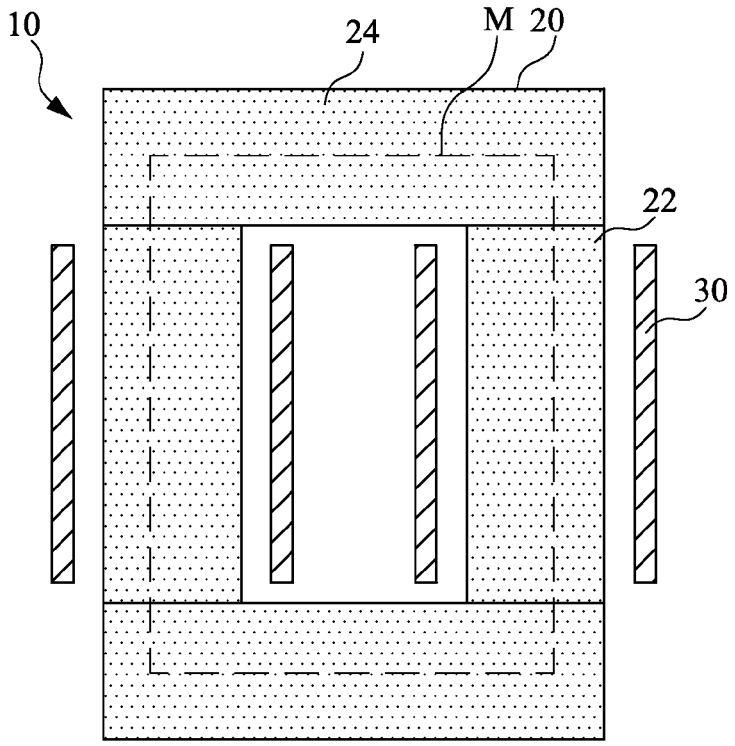
Fig. 1A ( PRIOR ART )
FIG. 1A to FIG. 1C are cross-sectional schematic views of a traditional magnetic component.
Figure 1B:
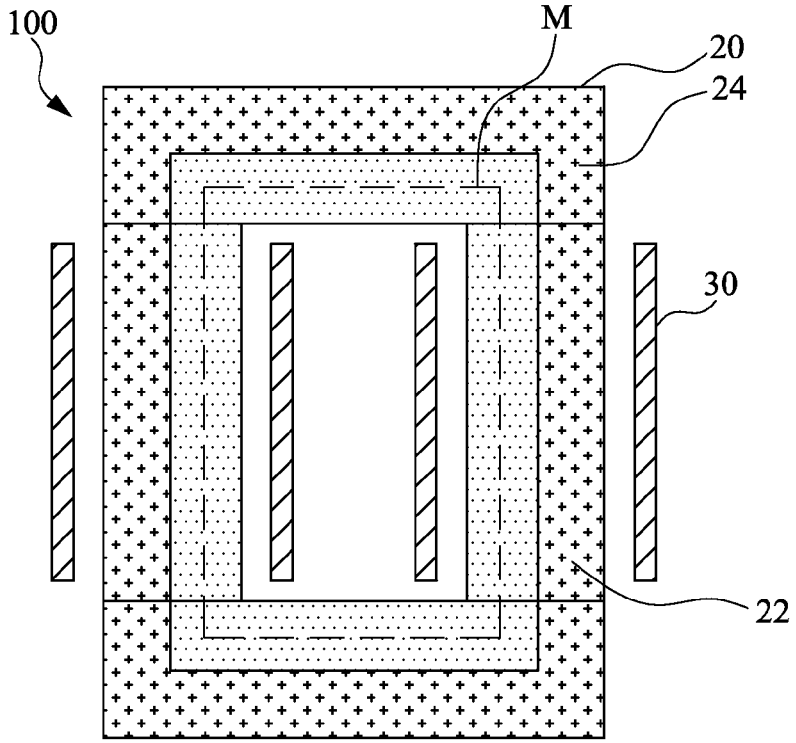
Fig. 1B ( PRIOR ART )
Figure 1C:
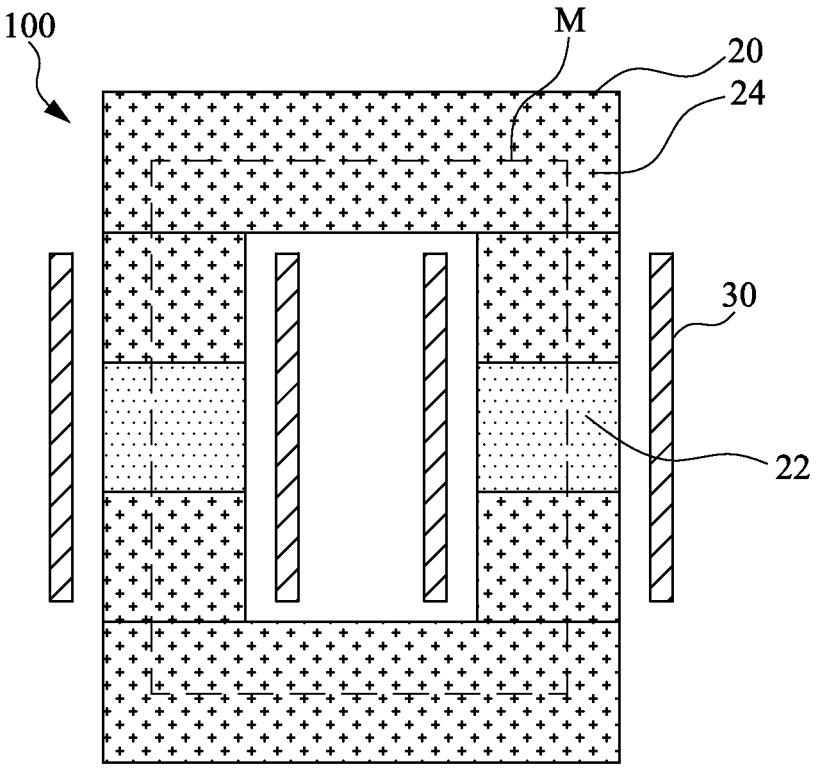
Fig. 1C ( PRIOR ART )

Reference will now be made in detail to the present embodiments of the invention, examples of which are illustrated in the accompanying drawings. Wherever possible, the same reference numbers are used in the drawings and the description to refer to the same or like parts.

Comparing to a uniform-filling magnetic core, the present invention suggests a concept of non-uniform filling section utilized in a magnetic core, which can provide higher initial inductance and better DC-bias characteristics. As opposed to the previously mentioned uniform-filling, the non-uniform filling indicated in this invention is a kind of magnetic material solely included in one cross section of the magnetic core perpendicular to its magnetic flux direction M; moreover, there are at least two kinds of magnetic material having different values of magnetic permeability in another cross section of the magnetic core perpendicular to its magnetic flux direction M. Details will be specifically described by following embodiments.

Figure 2:
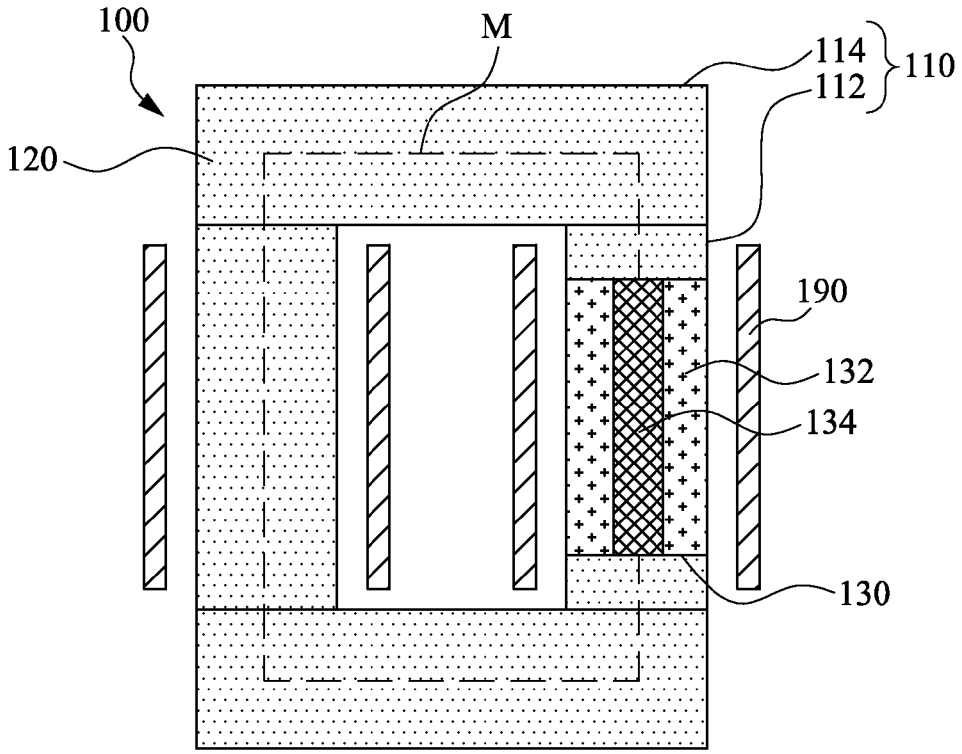
FIG. 2 is a cross-sectional schematic view of an embodiment of a magnetic component of the present invention.

FIG. 2 is a cross-sectional schematic view of an embodiment of a magnetic component of the present invention. The magnetic component 100 comprises a magnetic core 110 and a set of winding coil 190 winding on the magnetic core 110. The magnetic core 110 comprises a first magnetic material 120 and a non-uniform filling section 130, both of which are in connection to form the magnetic core 110. The first magnetic material 120 and the non-uniform filling section 130 are in connection to form a closed magnetic loop. That is, the magnetic 110 comprises a first and a second part: the first part comprises the first magnetic material 120, and the second part comprises the non-uniform filling section 130.

More specifically, the magnetic core 110 comprises a plurality of magnetic column 112 and magnetic covers 114, in which the magnetic columns 112 are all equal in length and parallel to each other; the magnetic covers 114 are disposed at the two ends of the magnetic columns 112 in order to form the closed magnetic loop by adhering closely with the magnetic columns 112. A set of winding coil 190 winds on the magnetic columns 112.

In this embodiment of the present invention, the magnetic cover 114 is a flat plate, and there are two in quantity for the magnetic columns 112 and the magnetic covers 114. However, in other embodiments, a shape of the magnetic core 110 can be changed according to different shapes of magnetic cover 114 and the quantity of the magnetic columns 112. For example, the magnetic core 110 can be ring-shaped, U-shaped, EE-shaped, EC-shaped, EQ-shaped, EFD-shaped, PQ-shaped, PT-shaped, RM-shaped, can-shaped, and etc.

The magnetic column 112 and the magnetic cover 114 can be connected by methods of applying adhering glue (e.g., epoxy, etc), compression, or fixture. A close-shaped formation of the magnetic core 110 configured by the magnetic column 112 and the magnetic cover 114 makes the magnetic core 110 the complete magnetic loop. The magnetic core 110 has a magnetic flux direction M, which passes a left magnetic column 112, a right magnetic column 112, an upper magnetic cover 114, and a bottom magnetic cover 114 to form the magnetic loop.

Figure 3A:
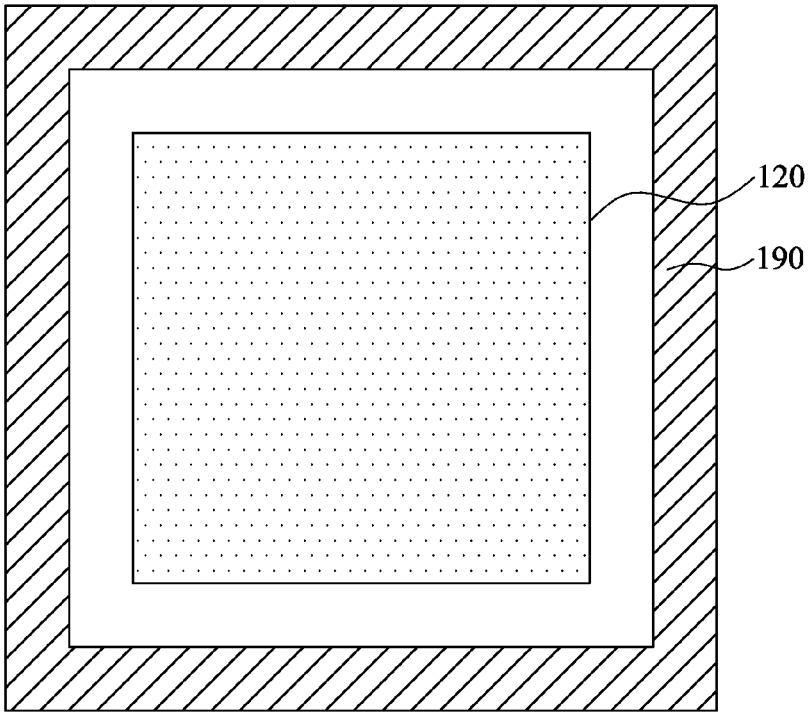
FIG. 3A is a cross-sectional view of a first magnetic material of FIG. 2, perpendicular to a magnetic flux direction.
Figure 3B:
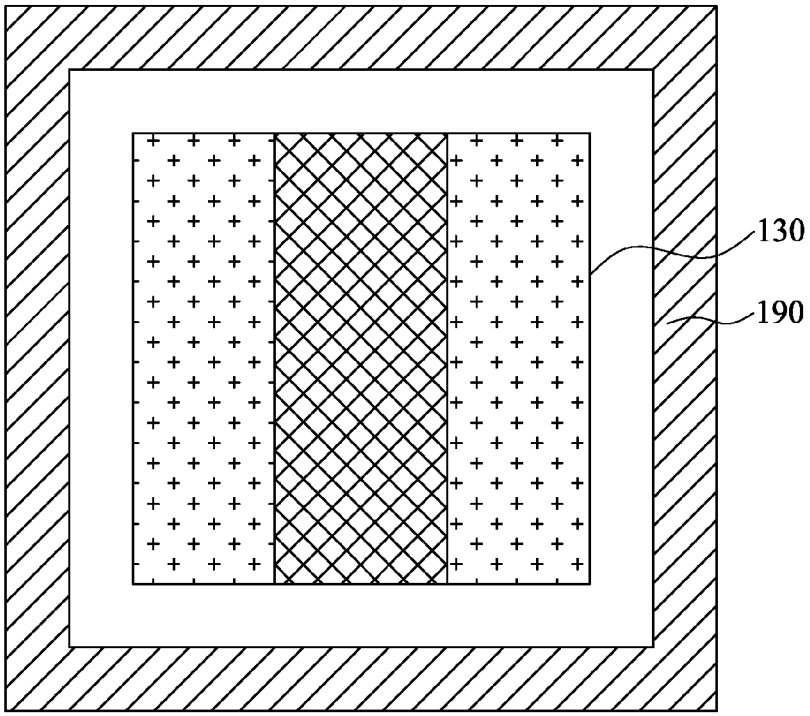
FIG. 3B is a cross-sectional view of a non-uniform filling section of FIG. 2, perpendicular to the magnetic flux direction.

The magnetic core 110 with non-uniform filling design comprises the first magnetic part, made by the first magnetic material 120, and the second magnetic part, made by the non-uniform filling section 130. In this embodiment, the non-uniform filling section 130 is disposed at the magnetic column 112. The first magnetic material 120 is made of a single kind of magnetic material, and the non-uniform filling section 130 is made of at least two kinds of magnetic material. More specifically, there is only one kind of magnetic material discoverable in the cross section perpendicular to the magnetic flux direction M of the first magnetic material 120, as shown in FIG. 3A; there are at least two kinds of magnetic material included in the cross section perpendicular to the magnetic flux direction M of the non-uniform filling section 130, as shown in FIG. 3B.

A kind of filling method is called the non-uniform filling if there is only one kind of magnetic material discoverable in the cross section perpendicular to the magnetic flux direction M of the first part of the magnetic core 110, and there are at least two kinds of magnetic material discoverable in the cross section perpendicular to the magnetic flux direction M of the second part of the magnetic core 110.

The previously cross section perpendicular to the magnetic flux direction M is a plane orthogonal to the magnetic flux direction M, meaning that a normal of this cross section is parallel to the magnetic flux direction M passing through the cross section.

Reference is made back FIG. 2. The non-uniform filling section 130 in FIG. 2 comprises a second magnetic material 132 and a third magnetic material 134, in which the third magnetic material 134 is placed between two pieces of the second magnetic material 132. The first magnetic material 120 and the non-uniform filling section 130 can be connected by methods of applying adhering glue, compression, or fixture. The second magnetic material 132 and the third magnetic material 134 can also be connected by methods of applying adhering glues, compression, or fixture.

The first magnetic material 120, the second magnetic material 132, and the third magnetic material 134 can have different values of magnetic permeability; or, in other embodiments, the value of magnetic permeability of the first magnetic material 120 can be identical to the value of magnetic permeability of the second magnetic material or the value of magnetic permeability of the third magnetic material, as long as the second magnetic material 132 in the non-uniform filling section 130 is different to the third magnetic material 134. One should be noted that the term of "magnetic permeability" in this disclosure is a relative magnetic permeability and the term of "initial magnetic permeability" in the disclosure is also a relative initial magnetic permeability, i.e. the relative magnetic permeability when the applied current is zero.

In this embodiment, the first magnetic material 120, the second magnetic material 132, and the third magnetic material 134 possess a first, a second, and a third magnetic permeability, respectively. The first, second, and third magnetic permeability are with different values in regard to each other. The magnetic permeability of the second magnetic material 132 and the magnetic permeability of the third magnetic material 134 are more than 5. Also, a combined volume of the second magnetic material 132 and the third magnetic material 134 occupies 10% to 90% of total volume in the magnetic core 110.

According to this embodiment, if the value of magnetic permeability of the third magnetic material 134 is less than that of the first magnetic material 120 and the second magnetic material 132, and if the magnetic permeability and a size of the magnetic material are properly chosen, an initial inductance of the magnetic component 100 can be improved vastly. On the other hand, if the value of magnetic permeability of the third magnetic material 134 is more than that of the first magnetic material 120 and the second magnetic material 132, and if the magnetic permeability and a size of the magnetic material are properly chosen, an DC-bias characteristic of the magnetic component 100 can be improved vastly.

Figure 4A:
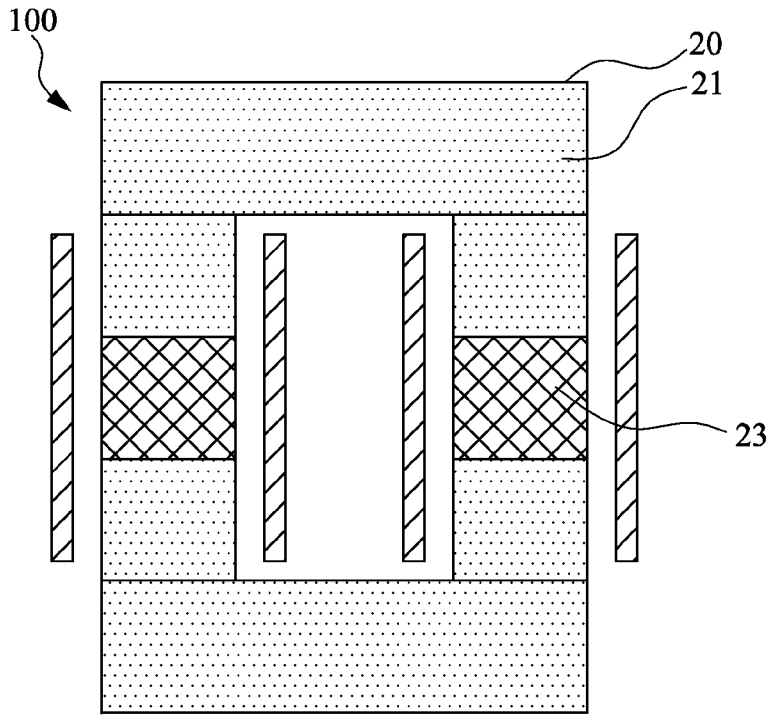
Fig. 4A ( PRIOR ART )
FIG. 4A is a schematic diagram of the traditional magnetic core using uniform filling method.
Figure 4B:
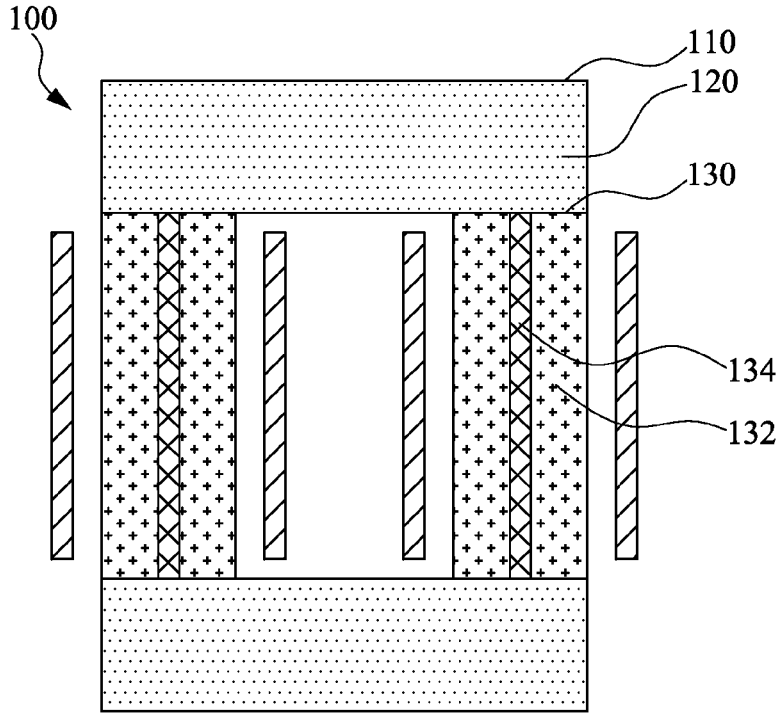
FIG. 4B is a schematic diagram of the magnetic core using non-uniform filling method of the invention.

Citing a reactor with Block magnetic core produced by Magnetics, Inc., as an example, the magnetic core can be made by two kinds of magnetic material, kool-u 26 and kool-u 125, as structures shown in FIG. 4A and FIG. 4B. The magnetic material kool-u 26 has a relative initial magnetic permeability 26, and the magnetic material of kool-u 125 has a relative initial magnetic permeability 125. In FIG. 4A, the magnetic core 20 using traditional uniform filling method is composed with kool-u 125 in the first part 21 and kool-u 26 in the second part 23. In FIG. 4B, the magnetic core 110 using non-uniform filling method of the present invention comprises the first magnetic material 120 and the non-uniform filling section 130, wherein the non-uniform filling section 130 comprises the second magnetic material 132 and the third magnetic material 134.

Figure 5A:
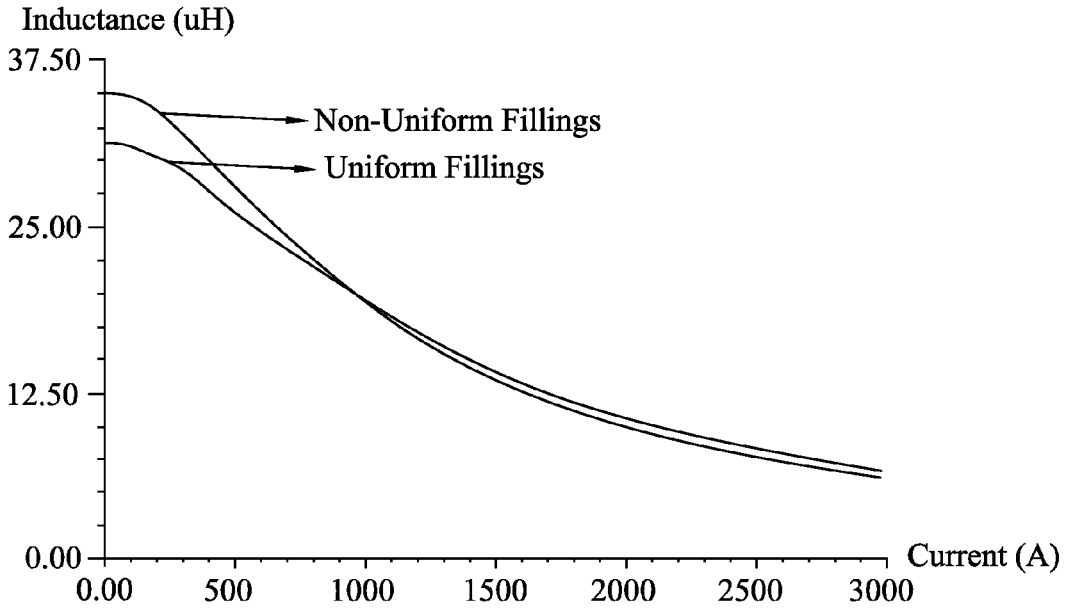
FIG. 5A is a simulation result of inductances varied with different currents utilizing the traditional uniform-filling magnetic component as illustrating in FIG. 4A, and one embodiment of the magnetic component using non-uniform filling sections as illustrating in FIG. 4B of this invention.

FIG. 5A is a simulation result of inductances varied with different currents utilizing the traditional uniform-filling magnetic component as illustrating in FIG. 4A, and one embodiment of the magnetic component using non-uniform filling sections as illustrating in FIG. 4B of this invention. The first magnetic material 120, the second magnetic material 132, and the third magnetic material 134 are kool-u 125, kool-u 125, and kool-u 26, respectively. As shown in FIG. 5A, when the value of magnetic permeability of the third magnetic material 134 is less than that of the first magnetic material 120, a higher value of initial inductance will be induced in terms of the magnetic core 110 using the non-uniform filling method.

Figure 5B:
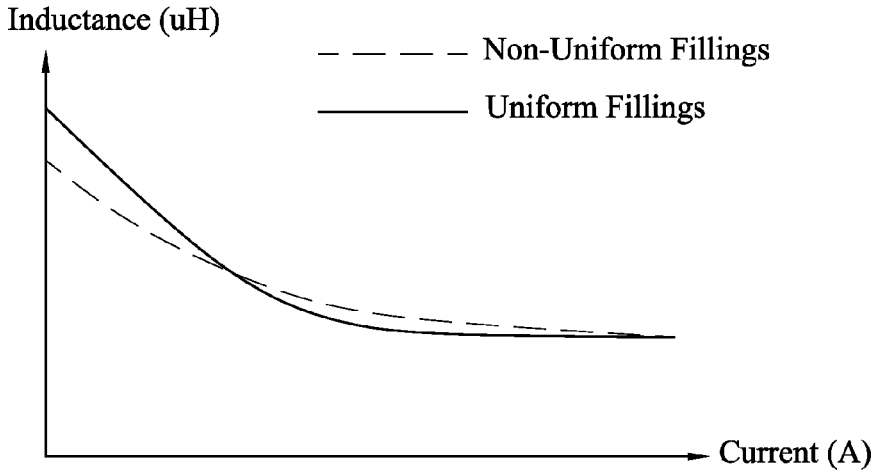
FIG. 5B is a simulation result of inductances varied with different currents utilizing the traditional uniform-filling magnetic component as illustrating in FIG. 4A, and another embodiment of the magnetic component using non-uniform filling sections as illustrating in FIG. 4B of this invention.

FIG. 5B is a simulation result of inductances varied with different currents utilizing the traditional uniform-filling magnetic component as illustrating in FIG. 4A, and another embodiment of the magnetic component using non-uniform filling sections as illustrating in FIG. 4B of this invention. The first magnetic material 120, the second magnetic material 132, and the third magnetic material 134 are kool-u 26, kool-u 26, and kool-u 125, respectively, meaning that the value of magnetic permeability of the third magnetic material 134 is more than that of the first magnetic material 120. As opposed to the magnetic component in FIG. 4A, the first part 21 and the second part 23 of the magnetic component comprise kool-u 26 and kool-u 125, respectively. According to FIG. 5B, the magnetic core 110 using non-uniform filling method in FIG. 4B has better DC-bias characteristics.

Therefore, the user can manage to determine the first magnetic material 120, the second magnetic material 132, and the third magnetic material 134 according to needs in practices in order to let the magnetic component 100 with non-uniform filling section 130 provide good DC-bias characteristics, higher inductance in specific loads, or less loss in a condition of the same inductance applied.

In other embodiments, the non-uniform filling section 130 can of course comprise more than two kind of magnetic material, meaning that there are three or four kinds of magnetic material having different values of magnetic permeability comprised in the non-uniform filling section 130. Magnetic core may also has a plurality of the non-uniform filling sections 130, and the non-uniform filling sections 130 can comprises different magnetic materials satisfying the requirement of there are at least two kinds of magnetic material at the cross section perpendicular to the magnetic flux direction M.

Figure 6:
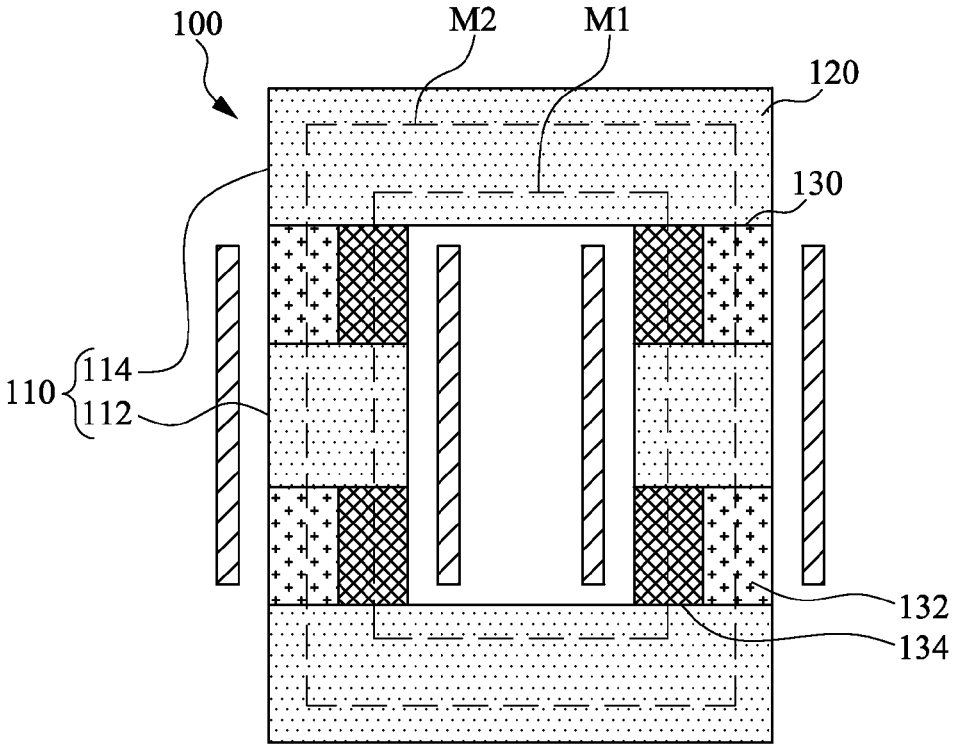
FIG. 6 to FIG. 8 are cross-sectional views of different embodiments of the magnetic component of the invention.

FIG. 6 is a cross-sectional view of an embodiment of the magnetic component of the invention. The magnetic component 100 comprises a plurality of the first magnetic materials 120 and a plurality of non-uniform filling sections 130 in connection to each other. The first magnetic material 120 is made of a single kind of magnetic material, and the non-uniform filling section 130 comprises the second magnetic material 132 and the third magnetic material 134 having different values of magnetic permeability. Two of the non-uniform filling sections 130 are disposed at two ends of the magnetic columns 112 near to the magnetic cover 114.

The magnetic core 110 comprises an inner side, which faces the space between the magnetic columns 112, and an outer side, which faces away from the space between the magnetic columns 112. More specific, the magnetic core 110 has two magnetic columns 112 facing each other and has the space between the magnetic columns 112. The inner side represents the portion of the magnetic columns 112 adjacent to the space, and the outer side is the portion of the magnetic columns 112 far away from the space. The second magnetic material 132 is disposed at the outer side of the magnetic core 110, and the third magnetic material 134 is disposed at the inner side of the magnetic material 110.

In this embodiment, the magnetic core 110 comprises a fixed magnetic flux direction, in which the magnetic flux direction comprises an inner magnetic flux path M1, which is adjacent to the space between the magnetic columns 112, and an outer magnetic flux path M2, which is away from the space between the magnetic columns 112 The second magnetic material 132 is disposed at where an outer magnetic flux path M2 passes through, and the third magnetic material 134 is disposed at where an inner magnetic flux path M1 passes through. It should be noted that, according to different kinds of magnetic core 110, an amount of the magnetic flux direction would vary with the amount of the magnetic columns 112, and definitions of the inner magnetic flux path and the outer magnetic flux path would be slightly adjusted. However, it is basically described as above that the inner side of the magnetic core 110 is adjacent to the space formed by the magnetic columns, and the outer side of the magnetic core 110 is far away from the space formed by the magnetic columns.

The magnetic columns 112 and the magnetic covers 114 or the first magnetic materials 120 and the non-uniform filling sections 130 can be connected by methods of applying adhering glues, compression, or fixture. To avoid redundancy, the methods will be referenced thereafter. The first magnetic material 120, the second magnetic material 132, and the third magnetic material 134 can possess the first, the second, and the third magnetic permeability, respectively, as shown in FIG. 6. Or, the second magnetic material 132 can be identical to the first magnetic material 120, as long as the value of magnetic permeability of the second magnetic material 132 is different to that of the third magnetic material 134.

Figure 7:
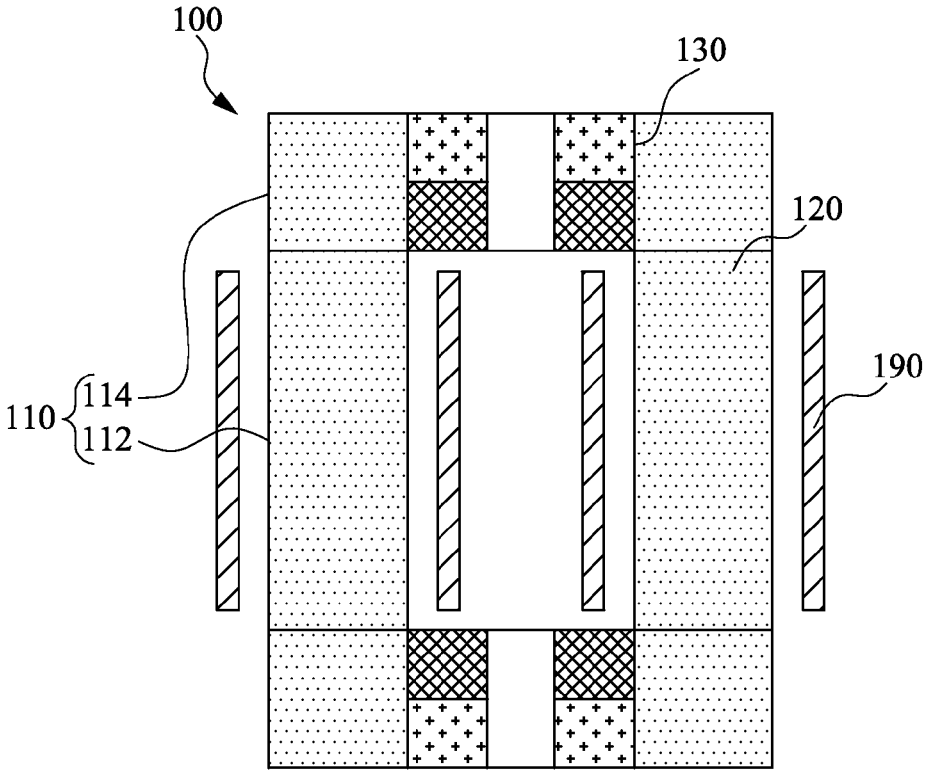

FIG. 7 is a cross-sectional view of another embodiment of the magnetic component 100 of the present invention. The magnetic component 100 comprises the first magnetic materials 120 and the non-uniform filling sections 130 in connection to each other, in which the non-uniform filling section 130 is disposed at the magnetic cover 114 near to two ends of the magnetic columns 112, and a plurality of the non-uniform filling sections 130 are assigned to each of the magnetic covers 114. A set of winding coil 190 winds on the magnetic column 112 made of the first magnetic material 120.

Figure 8:
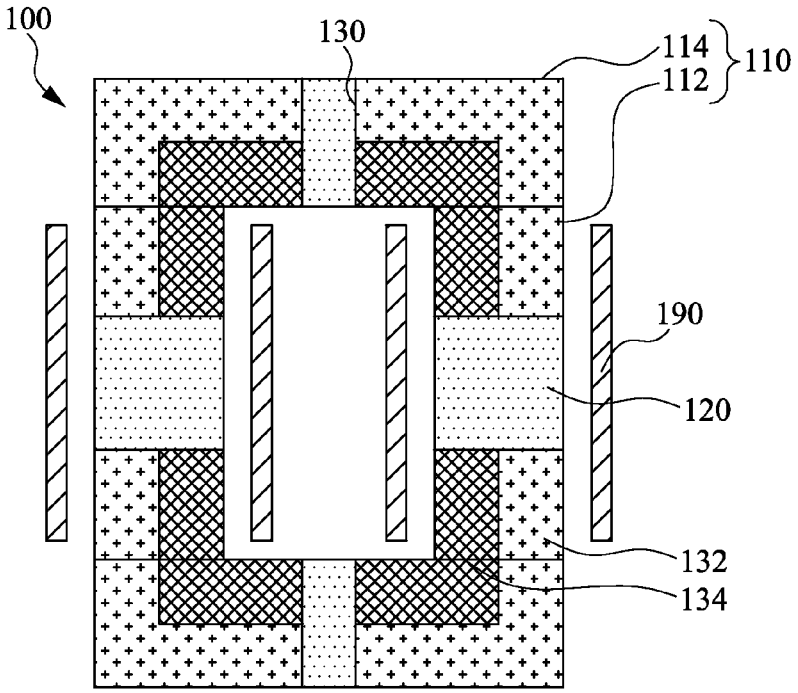

FIG. 8 is a cross-sectional view of one another embodiment of the magnetic component 100 of the present invention. The magnetic component 100 comprises the first magnetic materials 120 and the non-uniform filling sections 130 in connection to each other, in which the non-uniform filling sections 130 are disposed at a corner of connection between the magnetic columns 112 and the magnetic covers 114. Similarly, the non-uniform filling section 130 comprises the second magnetic material 132 and the third magnetic material 134, in which the second magnetic material 132 is disposed at the outer side of a corner of connection between the magnetic cover 114 and the magnetic column 112, the third magnetic material 134 is disposed at the inner corner of connection between the magnetic cover 114 and the magnetic column 112. If the first magnetic permeability of the first magnetic material 120 is different to the second magnetic permeability or the third magnetic permeability in the non-uniform filling section 130, both values of the second magnetic permeability of the second magnetic material 132 and the third magnetic permeability of the third magnetic material 134 should be more than 5; also, a combined volume of the second magnetic material 132 and the third magnetic material 134 occupies 10% to 90% of total volume in the magnetic core 110.

In this embodiment, the second magnetic material 120 and the first magnetic material 130 are identical. The value of magnetic permeability of the third magnetic material 134 is more than 5 and, at the same time, more than that of the first magnetic material. The volume of the third magnetic material 134 occupies 10% to 90% of total volume in the magnetic core 110.

As previously described, if the value of the second magnetic permeability or the third magnetic permeability is less than that of the first magnetic permeability, the non-uniform filling magnetic core 110 can provide higher initial inductance as opposed to the uniform filling magnetic core; in contrast, if the value of the second magnetic permeability or the third magnetic permeability is more than that of the first magnetic permeability, the non-uniform filling magnetic core 110 can improve DC-bias characteristics as opposed to the uniform filling magnetic core.

Reference is made to FIG. 6 to FIG. 8 again. There would be normally a larger turn for the magnetic component 100 at the corner of connection between the magnetic column 112 and the magnetic cover 114. At this corner, a relevant air reluctance along the magnetic core 110 is short in length and thus lower in magnetic reluctance, so there are more magnetic leakages to air. If there is a larger magnetic permeability included in the non-uniform filling section 130 at a place near to the corner, as shown in FIG. 6 and FIG. 7, or if there is a larger magnetic permeability included in the non-uniform filling section 130 right at the corner, as shown in FIG. 8, the magnetic reluctance of the magnetic core 110 would be reduced efficiently at the corner. The magnetic leakage would be further bypassed from leaking to the air, and an eddy current loss would be reduced at the corner of the winding coil 190. In other words, if the value of magnetic permeability of the third magnetic material 134 is more than that of the first magnetic material 120, less loss can be expected.

According to the simulation result, if the first magnetic material 120 and the second magnetic material 132 is the magnetic material having the initial magnetic permeability 26, and if the third magnetic material 134 is the magnetic material having the initial magnetic permeability 60, as shown in FIG. 8, an loss in the set of winding coil comprised in the non-uniform filling magnetic core 110 can have a 13% of decrease as opposed to the traditional uniform filling magnetic core using only the initial magnetic permeability 26.

Figure 9:
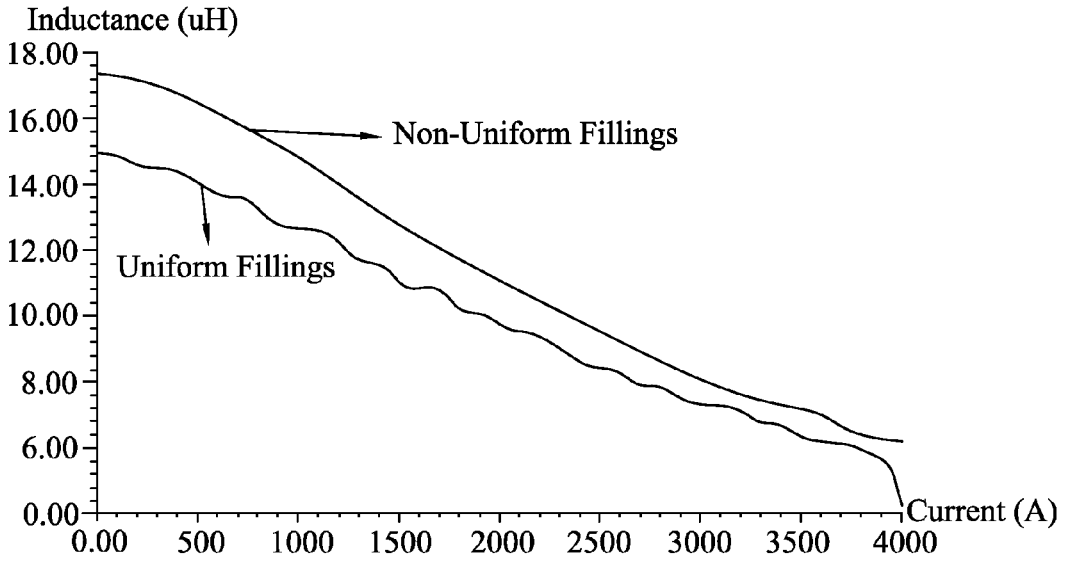
FIG. 9 is a simulation result of inductances varied with different currents utilizing the traditional uniform-filling magnetic component as illustrating in FIG. 4A, and one embodiment of the magnetic component using non-uniform filling sections of the invention as illustrating in FIG. 8.

FIG. 9 is a simulation result of inductances varied with different currents utilizing the traditional uniform-filling magnetic component as illustrating in FIG. 4A, and one embodiment of the magnetic component using non-uniform filling sections of the invention as illustrating in FIG. 8. In this embodiment, if the first magnetic material 120, the second magnetic material 132, and the third magnetic material 134 are kool-u 75, kool-u 75, and kool-u 26, respectively, meaning that the value of magnetic permeability of the third magnetic material 134 is less than that of the first magnetic material 120, the non-uniform filling magnetic core 110, disposed at the corner as shown in FIG. 8, would not only have higher initial inductance, but even higher inductance throughout an entire load current range.

FIG. 10 to FIG. 21 are cross-sectional schematic views of different embodiments of the magnetic component 100 of the present invention. The magnetic component 100 comprises the first magnetic material 120 and the non-uniform filling section 130, in which the non-uniform filling section 130 comprises the second magnetic material 132 and the third magnetic material 134 having different values of magnetic permeability. The values of magnetic permeability in the second magnetic material 132 and the first magnetic material 120 can be identical, while the value of magnetic permeability in the third magnetic material 134 should be more than 5 and the volume of the third magnetic material 134 occupies 10% to 90% of total volume of the magnetic core; or, the value of magnetic permeability of the first magnetic material 120, the second magnetic material 132, and the third magnetic material 134 are all different. Both values of magnetic permeability of the second magnetic material 132 and the third magnetic material 134 should be more than 5, while the combined volume of the second magnetic material 132 and the third magnetic material 134 occupies 10% to 90% of total volume of the magnetic core 110.

Figure 10:
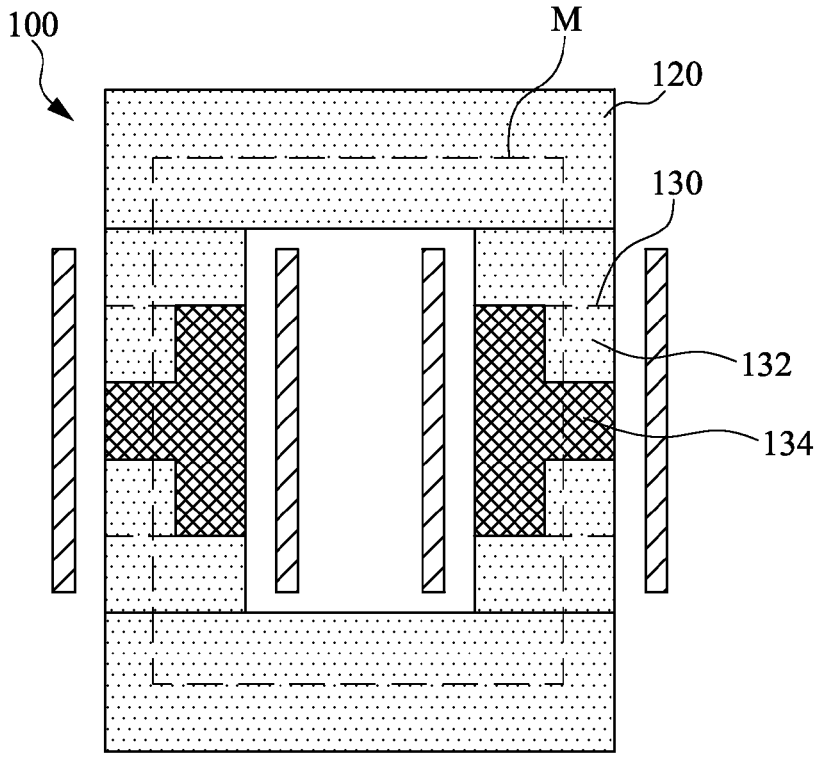
FIG. 10 to FIG. 22 are cross-sectional schematic views of different embodiments of the magnetic component of the invention.
Figure 11:
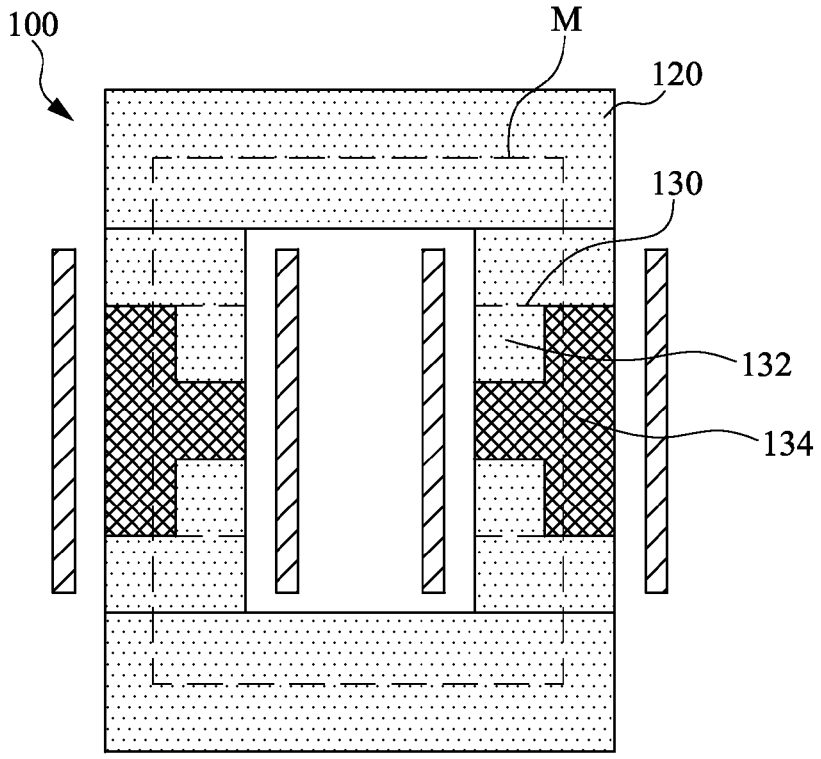
Figure 12:
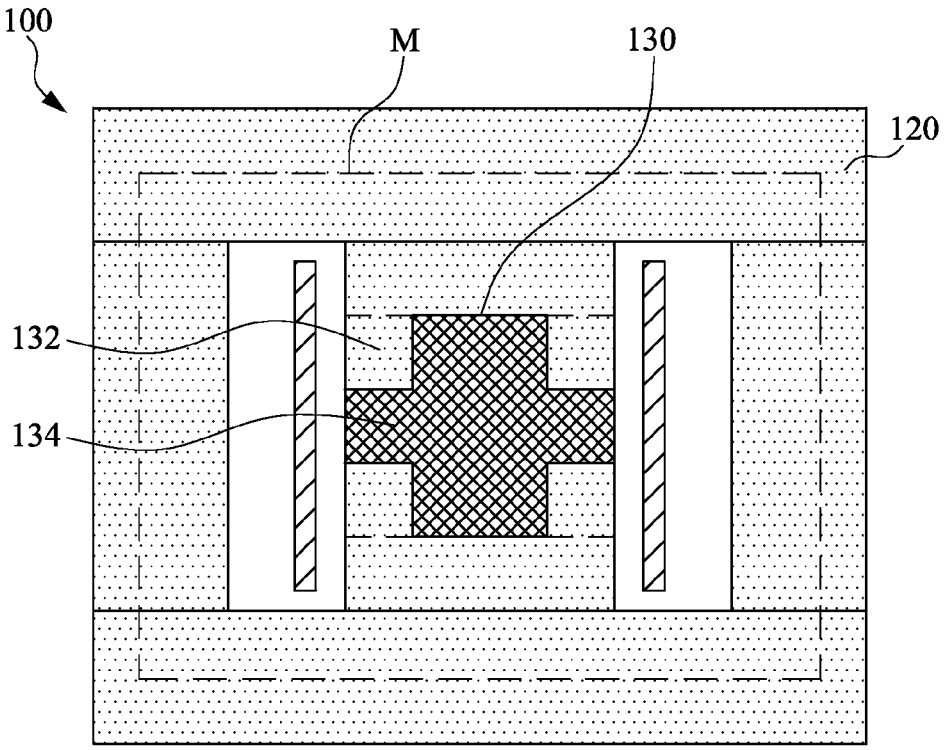
Figure 13:
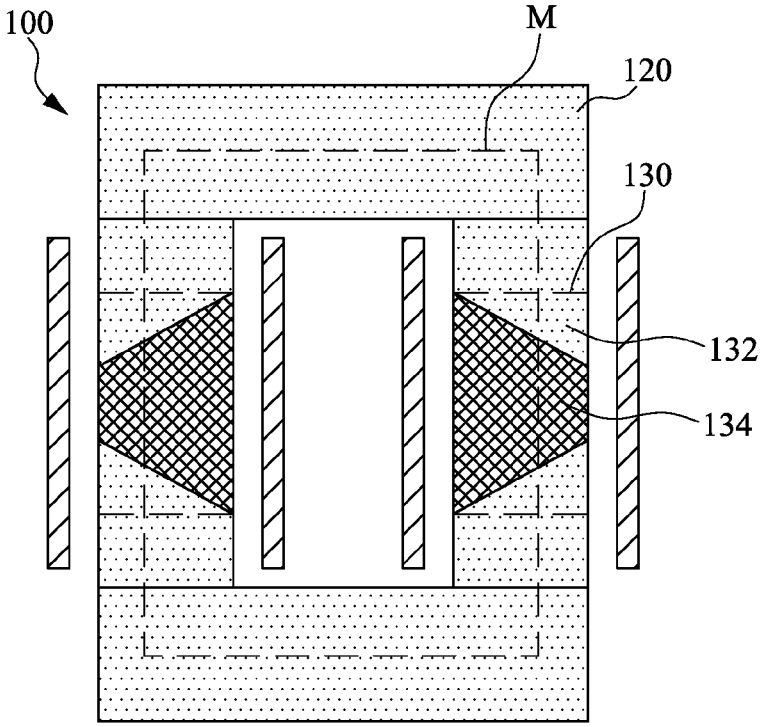
Figure 14:
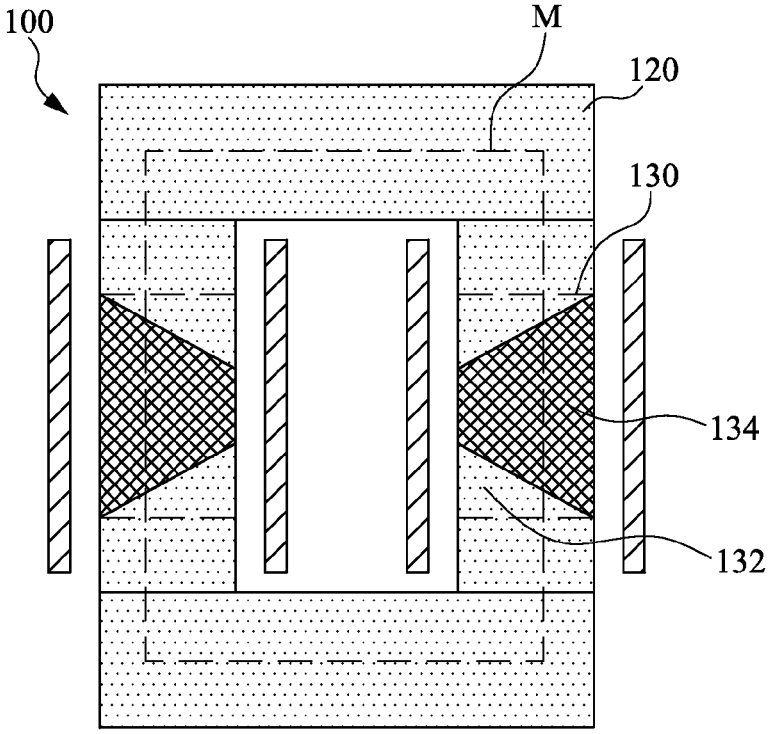
Figure 15:
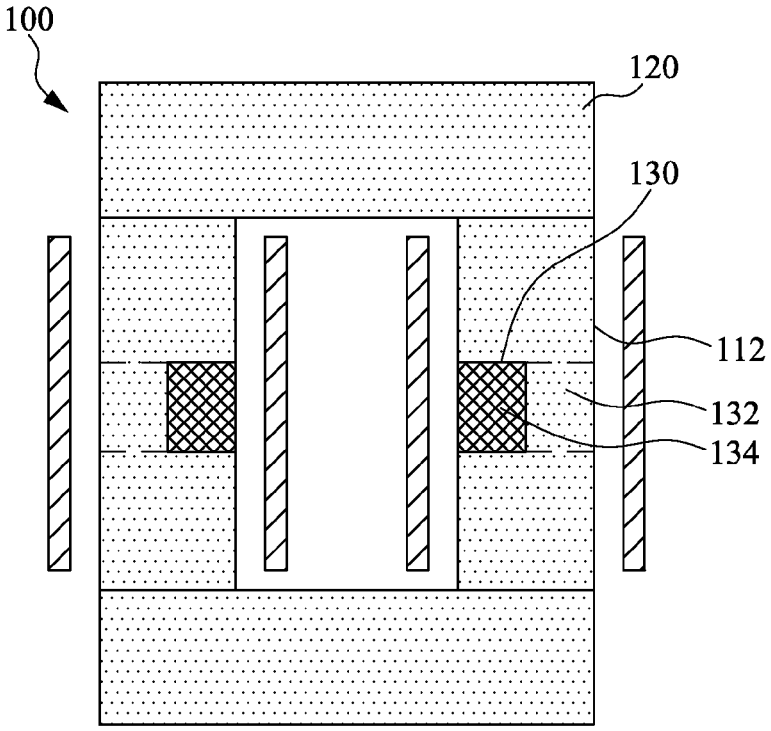
Figure 16:
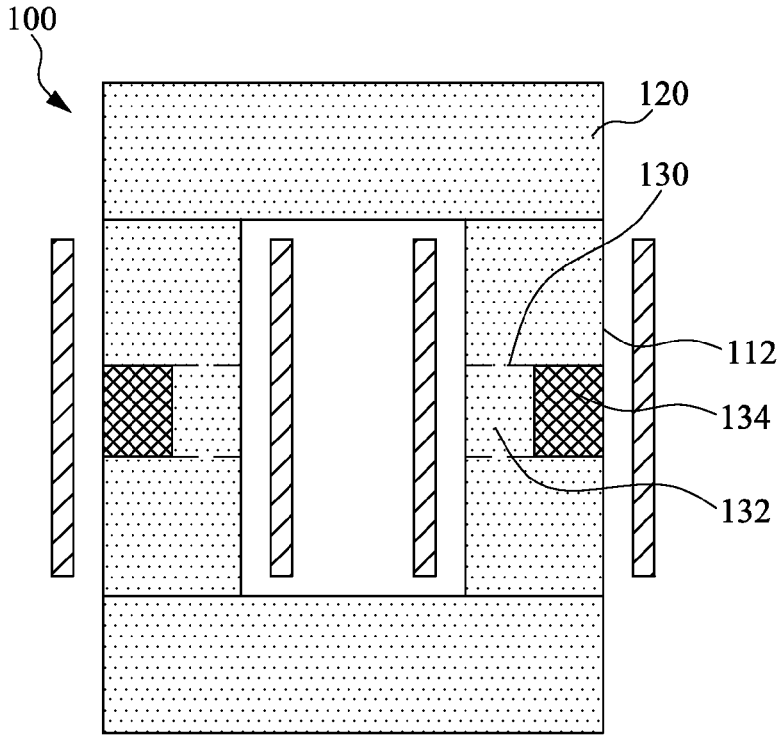
Figure 17:
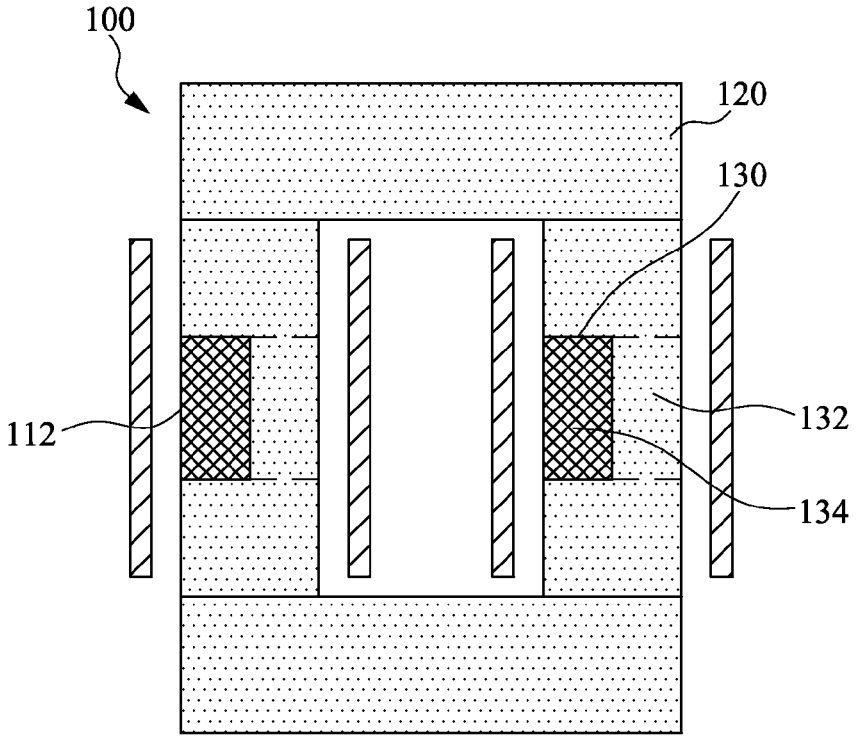
Figure 18:
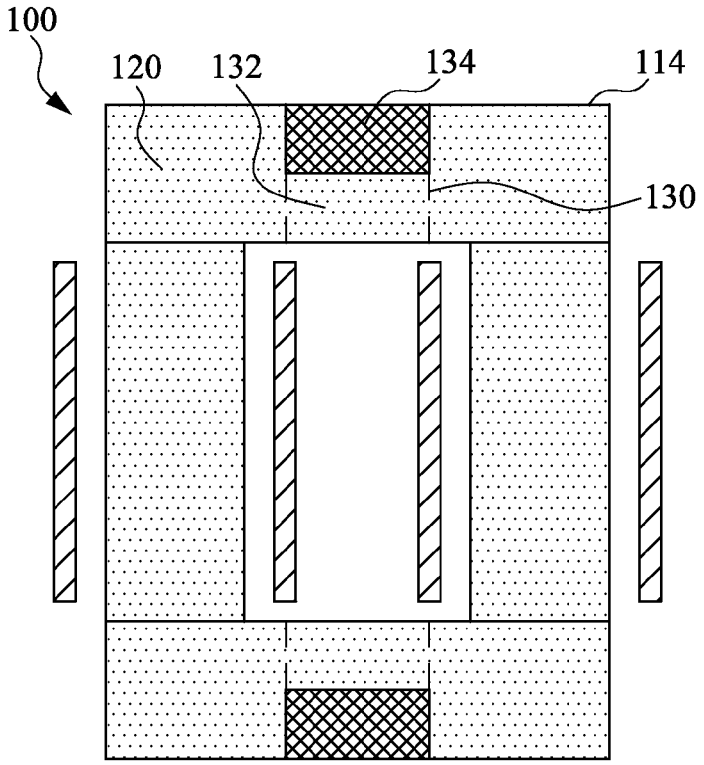

A cross-sectional shape of the third magnetic material 134 parallel to the magnetic flux direction M can be T-shaped as wide interior and narrow exterior, as shown in FIG. 10; the cross-sectional shape of the third magnetic material 134 parallel to the magnetic flux direction M can be T-shaped as wide exterior and narrow, interior as shown in FIG. 11; the cross-sectional shape of the third magnetic material 134 parallel to the magnetic flux direction M can be cross-shaped, as shown in FIG. 12; the cross-sectional shape of the third magnetic material 134 parallel to the magnetic flux direction M can be trapezoid-shaped as wide interior and narrow exterior, as shown in FIG. 13; and, the cross-sectional shape of the third magnetic material 134 parallel to the magnetic flux direction M can be trapezoid-shaped as narrow interior and wide exterior, as shown in FIG. 14. The third magnetic material 134 can be only disposed at the inner side of the magnetic column 112, as shown in FIG. 15; the third magnetic material 134 can be only disposed at the outer side of the magnetic column 112, as shown in FIG. 16; the third magnetic material 134 can be disposed both at the inner and outer side of the magnetic column 112, as shown in FIG. 17; and, the third magnetic material 134 can be also disposed at the outer side of the magnetic cover 114, as shown in FIG. 18.

Figure 19:
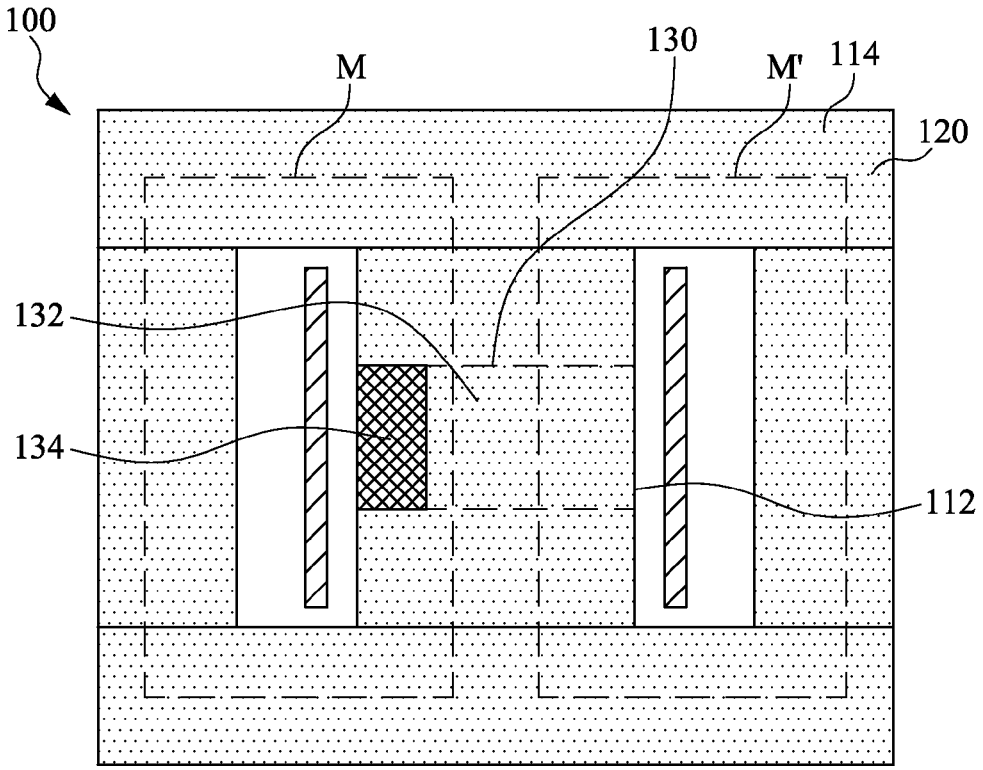
Figure 20:
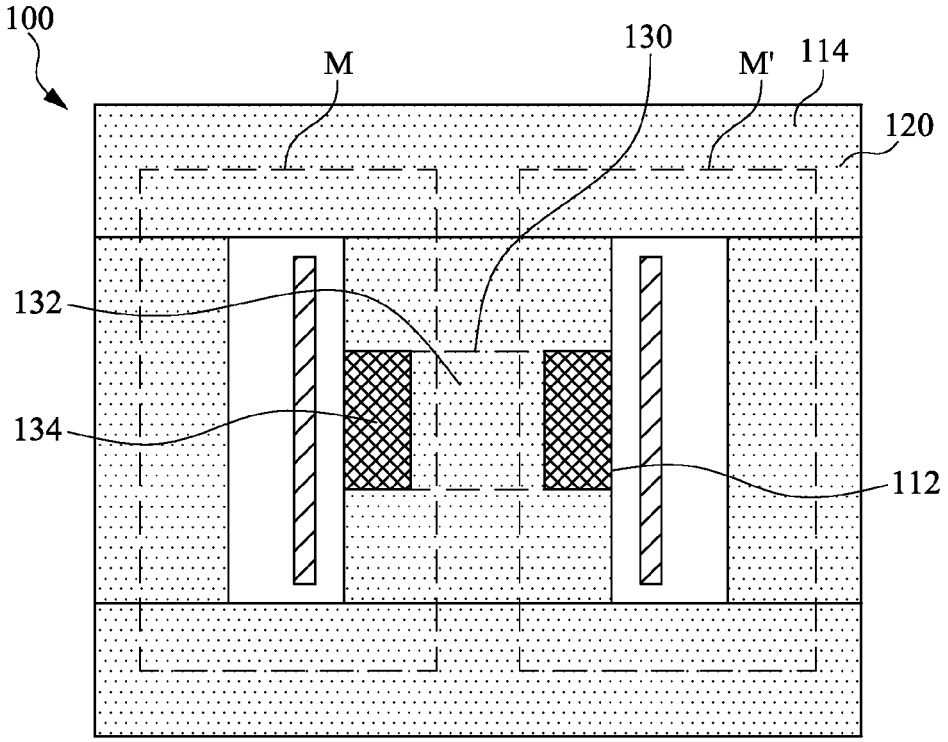
Figure 21:
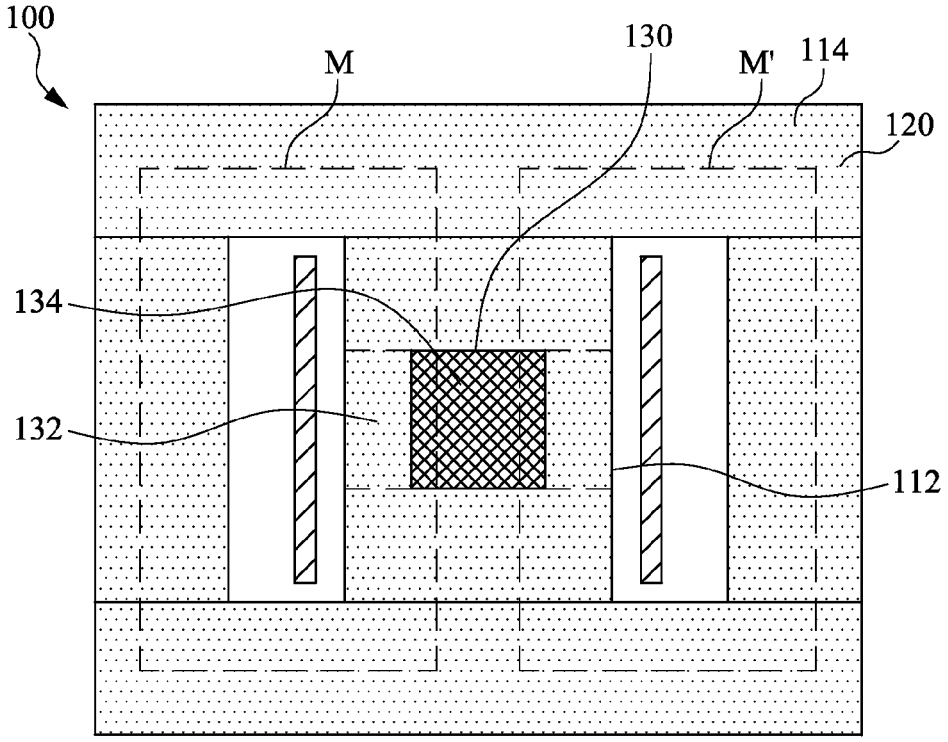

According to FIG. 19 to FIG. 21, if there are three in quantity of the magnetic columns 112, the magnetic core 110 comprises two set of the magnetic flux direction, M and M', in which one of the magnetic flux direction M' forms a closed magnetic flux path along the right side magnetic column 112, an upper magnetic cover 114, a middle magnetic column 112, an lower magnetic cover 114, and back to the right side magnetic column 112; the other magnetic flux direction M forms a closed magnetic flux path along the middle magnetic column 112, an upper magnetic cover 114, a left magnetic column 112, an lower magnetic cover 114, and back to the middle magnetic column 112.

The magnetic flux direction M or M' can include an inner magnetic flux path and an outer magnetic flux path. The inner magnetic flux path is more adjacent to the space between the magnetic columns 112 comparing to the outer magnetic flux path. For example, the inner magnetic flux path of the magnetic flux direction M passes the inner side of the upper magnetic cover 114, the left magnetic column 112, the lower magnetic cover 114, and the left side of the middle magnetic column 112; the outer magnetic flux path of the magnetic flux direction M passes the outer side of upper cover 114, the left magnetic column 112, the lower magnetic cover 114, and the middle portion of the middle magnetic column 112. The inner magnetic flux path of the magnetic flux direction M' passes the inner side of the upper magnetic cover 114, the right magnetic column 112, the lower magnetic cover 114, and the right side of the middle magnetic column 112; the outer magnetic flux path of the magnetic flux direction M' passes the outer side of upper cover 114, the lower magnetic cover 114, the right magnetic columns 112, and the middle portion of the middle magnetic column 112.

The third magnetic material 134 can be single in quantity and disposed at the inner side of the magnetic column 112, as shown in FIG. 19; the third magnetic material 134 can be multiple in quantity and disposed at the inner side of the magnetic column 112, as shown in FIG. 20; and, the third magnetic material 134 can be single in quantity and disposed at the middle of the magnetic column 112, that is, the outer side of the magnetic core, as shown in FIG. 21.

Figure 22:
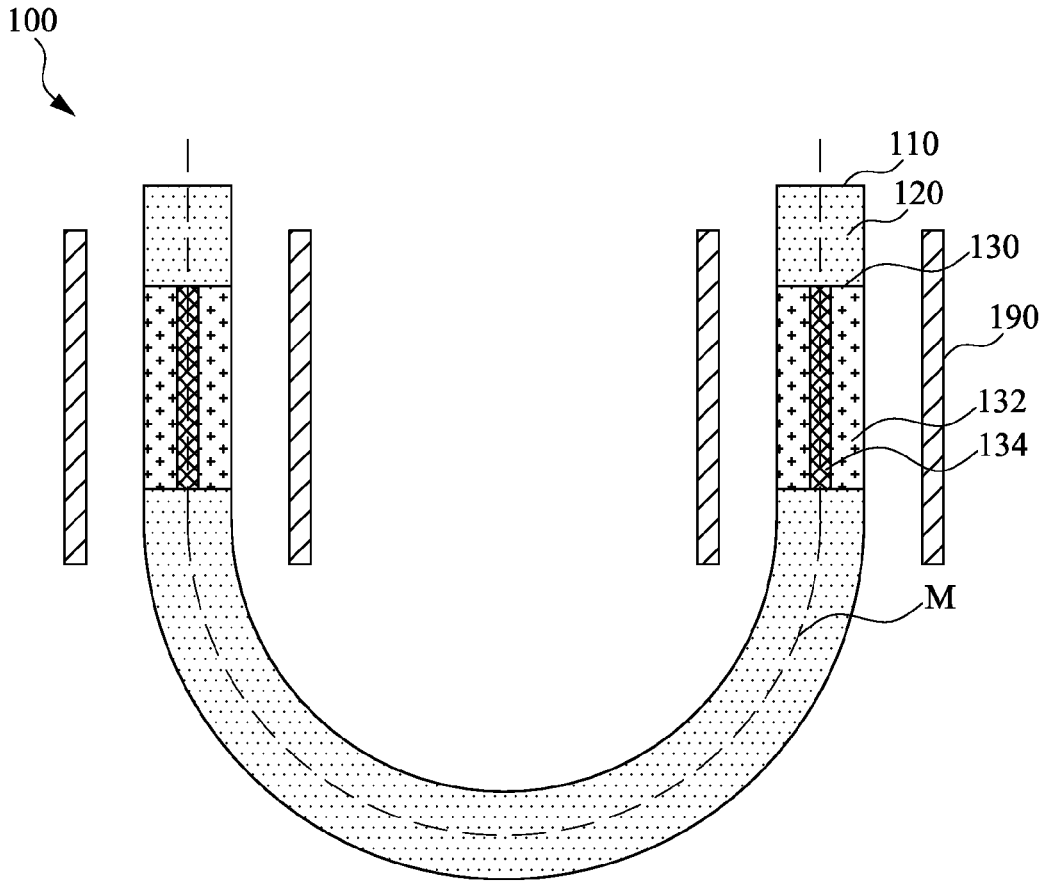

In addition, the concept of the non-uniform filling method of the present invention can be applicable to a ring-shaped magnetic core 110, as shown in FIG. 22. The ring-shaped magnetic core 110 still comprises a magnetic flux direction M and the non-uniform filling section 130, in which the non-uniform filling section 130 comprises the second magnetic material 132 and the third magnetic material 134 having different values of magnetic permeability at the cross section perpendicular to the magnetic flux direction. The values of magnetic permeability of the second magnetic material 132 and the first magnetic material 120 can be identical, while the value of magnetic permeability of the third magnetic material 134 should be more than 5 and the volume of the third magnetic material 134 occupies 10% to 90% of total volume of the magnetic core; or, the value of magnetic permeability of the first magnetic material 120, the second magnetic material 132, and the third magnetic material 134 are all different to each other, in which both values of magnetic permeability of the second magnetic material 132 and the third magnetic material 134 should be more than 5, while the combined volume of the second magnetic material 132 and the third magnetic material 134 occupies 10% to 90% of total volume of the magnetic core 110.

It should be noted that the embodiments described above are not used to limit the present invention, indicating that the quantity of the magnetic column in the magnetic core and the shape of the magnetic cover can be adjusted with respect to different needs. The magnetic core can be made of ferrites, magnetic powders, silicon steels, and etc. The quantity, size and disposing place of the first magnetic material and the non-uniform filling section can be also adjusted by different needs. The non-uniform filling section can be disposed near to the magnetic column and magnetic cover, or at the corner of connection between the two. The magnetic permeability of the magnetic material in the non-uniform filling section and the first magnetic material can be different or partially identical. The non-uniform filling section comprises at least two kind of magnetic materials having different values of magnetic permeability, meaning that the user can manage to determine arrangements or shapes between these materials according to different needs in practices, as long as the non-uniform filling section comprises at least two kinds of magnetic material having different magnetic permeability at the cross section perpendicular to the magnetic flux direction.

Comparing to the design with uniform-filling magnetic core, the design with non-uniform filling core can provide higher initial inductance and better DC-bias characteristics; this improved magnetic component can provide higher inductance in specific loads, or less loss in a condition of the same inductance applied.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A magnetic core having a magnetic flux direction, the magnetic core comprising:

a first magnetic material; and at least one non-uniform filling section connected to the first magnetic material, wherein the non-uniform filling section comprises a second magnetic material and a third magnetic material at a cross section perpendicular to the magnetic flux direction, the first, the second, and the third magnetic materials possess a first, a second, and a third magnetic permeability, respectively, and the third magnetic permeability is more than the first magnetic permeability and the second magnetic permeability.

2. The magnetic core according to claim 1, wherein the magnetic core comprises a plurality of magnetic columns and the non-uniform filling section is located at the magnetic columns.

3. The magnetic core according to claim 1, wherein the magnetic core comprises a plurality of magnetic covers, and the non-uniform filling section is located at the magnetic covers.

4. The magnetic core according to claim 1, wherein the magnetic core comprises a plurality of magnetic columns and a plurality of magnetic covers, and the non-uniform filling section is disposed at a corner of connection between the magnetic columns and the magnetic covers.

5. The magnetic core according to claim 1, wherein the first, the second, and the third magnetic permeability are different to each other.

6. The magnetic core according to claim 5, wherein both values of the second magnetic permeability and the third magnetic permeability are more than 5.

7. The magnetic core according to claim 1, wherein the second magnetic material and the third magnetic material respectively have values of the magnetic permeability different from each other, and the first and the second magnetic permeability are the same.

8. The magnetic core according to claim 7, wherein a value of the third magnetic permeability is more than 5.

9. The magnetic core according to claim 1, wherein the second magnetic material is disposed at an inner side of the magnetic core, and the third magnetic material is disposed at an outer side of the magnetic core.

10. The magnetic core according to claim 1, wherein the second magnetic material is disposed at the outer side of the magnetic core, and the third magnetic material is disposed at the inner side of the magnetic core.

11. The magnetic core according to claim 1, wherein the cross section of the third magnetic material in the parallel direction of its magnetic flux is trapezoid-shaped, cross-shaped, rectangle-shaped, L-shaped or T-shaped.

12. The magnetic core according to claim 5, wherein a combined volume of the second magnetic material and the third magnetic material occupies 10% to 90% of total volume in the magnetic core.

13. The magnetic core according to claim 7, wherein the volume of the third magnetic material occupies 10% to 90% of total volume in the magnetic core.

14. A magnetic component, comprising:

the magnetic core of claim 1; and a set of winding coil winding on a magnetic column of the magnetic core.

* * * * *